United States Patent [19]

Pittard et al.

[11] Patent Number: 5,036,921

[45] Date of Patent: Aug. 6, 1991

[54] UNDERREAMER WITH SEQUENTIALLY EXPANDABLE CUTTER BLADES

[75] Inventors: Fred J. Pittard, Richmond; Jimmy D. Fultz, Houston, both of Tex.

[73] Assignee: Slimdril International, Inc., Houston, Tex.

[21] Appl. No.: 544,910

[22] Filed: Jun. 28, 1990

[51] Int. Cl.[5] ..... E21B 10/32; E21B 29/00

[52] U.S. Cl. ..... 166/298; 166/55.8; 166/376; 175/266; 175/286; 175/267

[58] Field of Search ..... 166/298, 297, 376, 55.8, 166/55.7; 175/266, 265, 267, 284, 286

[56] References Cited

U.S. PATENT DOCUMENTS

| | | | |
|---|---|---|---|
| 2,548,931 | 4/1951 | Baker | 175/285 |
| 2,644,673 | 7/1953 | Baker | 175/285 |
| 2,822,150 | 2/1958 | Muse et al. | 175/266 |
| 2,899,000 | 8/1959 | Medders et al. | 166/55.8 |
| 3,050,122 | 8/1962 | Huitt et al. | 166/55.8 |
| 3,817,339 | 6/1974 | Furse | 175/286 X |
| 4,565,252 | 1/1986 | Campbell et al. | 175/269 |
| 4,646,826 | 3/1987 | Bailey et al. | 175/286 X |
| 4,809,793 | 3/1989 | Hailey | 175/266 X |

*Primary Examiner*—Stephen J. Novosad
*Attorney, Agent, or Firm*—Neal J. Mosely

[57] ABSTRACT

An underreamer tool has a body with upper and lower portions having an upper cutter blade slot extending transversely through the upper portion and a lower cutter blade slot extending transversely through the lower portion at a right angle thereto. The upper and lower portions have central bores separated by a wall and connected by upper and lower fluid flow passageways bypassing the cutter blade slots. An upper pair of cutter blades mounted in the upper cutter blade slot and a lower pair of cutter blades mounted in the lower cutter blade slot move between a retracted position within the slots and an extended position outward therefrom. An upper piston in the central bore above the upper cutter blade slot has its bottom end engaged on the upper cutter blades and a lower piston in the central bore above the lower cutter blade slot has its bottom end engaged on the lower cutter blades. The upper piston moves between a first position substantially closing the upper passageway and a second position opening in upper passageway responsive to fluid force acting thereon. The lower piston moves between a first position substantially closing the lower passageway and a second position opening the passageway responsive to the upper passageway being opened by the upper piston whereby the lower cutter blades are extended only after the upper cutter blades have been extended and, after both the upper and lower cutter blades have been extended, a continuous fluid flow path is established from the upper end of the tool to a drill bit at the lower end of the tool.

34 Claims, 3 Drawing Sheets

UNDERREAMER WITH SEQUENTIALLY EXPANDABLE CUTTER BLADES

BACKGROUND OF THE INVENTION

1. FIELD OF THE INVENTION

This invention relates generally to borehole operating tools such as underreamers, and more particularly to an underreamer having an upper and lower set of expandable cutter blades engaged by and controlled by fluid operated pistons whereby the lower set of expandable arms are expanded only after the upper set has been expanded.

2. BRIEF DESCRIPTION OF THE PRIOR ART

Underreamers are a type of borehole operating tool for use in enlarging an oil well borehole which was initially bored by the drill bit. A typical underreamer includes expandable arms mounted in a housing by suitable hinge pins for movement between a withdrawn or closed position and an open, expanded position. Typically, the expandable arms are moved outwardly by means of a pressure actuated piston mounted within the main bore of the tool housing. The ends of the expandable arms are usually provided with a machined surface or cutting inserts for engaging certain types of formations and cutting a larger hole than created by the drill bit. There are several patents which disclose various underreaming tools.

Muse et al, U.S. Pat. No. 2,822,150 discloses a rotary expansible drill bit having upper and lower cutters pivotally mounted on a main body and connected by a rack and pinion mechanism to a plunger for simultaneously expanding the cutters outwardly from the main body.

Hailey, U.S. Pat. No. 4,809,793 discloses a downhole cutting tool which includes longitudinal bores which are opened to fluid flow when the cutting members are moved to their extended positions. The tool has upper and lower subassemblies connected together through an adapter which establishes an angular offset between an upper and lower pair of extendible cutter members. However, in both the upper and lower subassemblies, one passage is continuously open to fluid flow at all times and the other passage is initially closed and only opens on predetermined movement of the piston or pistons which open the extendible cutters. The present invention has a different sequence of operation resulting from a different internal construction. In the present invention, the flow passages in both the upper and lower body portions are not open to flow until the upper piston has first moved to open the upper flow passages.

Baker, U.S. Pat. Nos. 2,548,931 and 2,644,673, and Huitt et al, U.S. Pat. No. 3,050,122 disclose underreamers having cutter blades pivotally mounted on a main body and connected by link members to a plunger for simultaneously expanding the cutters outwardly from the main body.

Emanuel et al, U.S. Pat. No. 2,756,968 discloses an expansible well scraper having scraper blades pivotally mounted on a main body and connected by a toothed mechanism to a plunger for simultaneously expanding the cutters outwardly from the main body.

Campbell et al, U.S. Pat. No. 4,565,252 discloses an underreamer or milling tool having simultaneously expansible arms pivotally mounted on a main body. A rotary fluid housing is mounted within each arm and includes a body nozzle for receiving fluid from the body and an expandable arm nozzle for directing fluid into a bore which extends through the arm to provide circulating fluid outwardly of the expandable arm.

The present invention is distinguished over the prior art in general, and these patents in particular by an underreamer tool having upper and lower portions with an upper cutter blade slot extending transversely through the upper portion and a lower cutter blade slot extending transversely through the lower portion at right angles to one another. The upper and lower portions have central bores connected by upper and lower fluid flow passageways bypassing the cutter blade slots. An upper pair of cutter blades mounted in the upper cutter blade slot and a lower pair of cutter blades mounted in the lower cutter blade slot move between a retracted position within the cutter blade slot and an extended position outward from the cutter blade slot. An upper piston in the central bore above the upper cutter blade slot has its bottom end engaged on the upper cutter blades and a lower piston in the central bore above the lower cutter blade slot has its bottom end engaged on the lower cutter blades. The upper piston moves between a first position substantially closing the upper passageway and a second position opening the upper passageway responsive to fluid force acting thereon. The lower piston moves between a first position substantially closing the lower passageway and a second position opening the passageway responsive to the upper passageway being opened by the upper piston whereby the lower cutter blades are extended only after the upper cutter blades have been extended and after both the upper and lower cutter blades have been extended a continuous fluid flow path is established from the upper end of the tool to a drill bit at the lower end of the tool.

SUMMARY OF THE INVENTION

It is therefore an object of the present invention to provide an underreamer tool having an upper and lower set of expandable cutter blades connected and controlled by fl id operated pistons whereby the lower set of expandable cutter blades are expanded only after the upper set has been expanded.

It is another object of this invention to provide an underreamer tool having an upper and lower set of expandable cutter blades which has no threaded connection or intermediate sub between the upper and lower set of cutter blades whereby the upper and lower cutter blades are accurately maintained in alignment at right angles to one another.

Another object of this invention is to provide an underreamer tool wherein continuous flow of fluid through internal passages is discharged to the drill bit after an upper and lower piston have been fully moved.

Another object of this invention is to provide an underreamer tool having an upper and lower fluid operated piston which requires no seal between the piston and the surrounding bore and allows a small amount of fluid to bypass the piston assembly to provide cleaning action of the mechanical portions of the cutter blades by the fluid.

A further object of this invention is to provide an underreamer tool wherein an upper pair and a lower pair of cutter blades extend outwardly in planes at a right angle to each other to stabilize the tool at four points equally spaced around the periphery of the bore hole.

A still further object of this invention is to provide an underreamer tool which is simple in construction, economical to manufacture, and rugged and reliable in use.

Other objects of the invention will become apparent from time to time throughout the specification and claims as hereinafter related.

The above noted objects and other objects of the invention are accomplished by an underreamer tool having upper and lower portions with an upper cutter blade slot extending transversely through the upper portion and a lower cutter blade slot extending transversely through the lower portion at right angles to one another. The upper and lower portions have central bores connected by upper and lower fluid flow passageways bypassing the cutter blade slots. An upper pair of cutter blades mounted in the upper cutter blade slot and a lower pair of cutter blades mounted in the lower cutter blade slot move between a retracted position within the cutter blade slot and an extended position outward from the cutter blade slot. An upper piston in the central bore above the upper cutter blade slot has its bottom end engaged on the upper cutter blades and a lower piston in the central bore above the lower cutter blade slot has its bottom end engaged on the lower cutter blades.

The upper piston moves between a first position substantially closing the upper passageway and a second position opening the upper passageway responsive to fluid force acting thereon. The lower piston moves between a first position substantially closing the lower passageway and a second position opening the passageway responsive to the upper passageway being opened by the upper piston whereby the lower cutter blades are extended only after the upper cutter blades have been extended and after both the upper and lower cutter blades have been extended a continuous fluid flow path is established from the upper end of the tool to a drill bit at the lower end of the tool.

DESCRIPTION OF A PREFERRED EMBODIMENT

Figure 1:
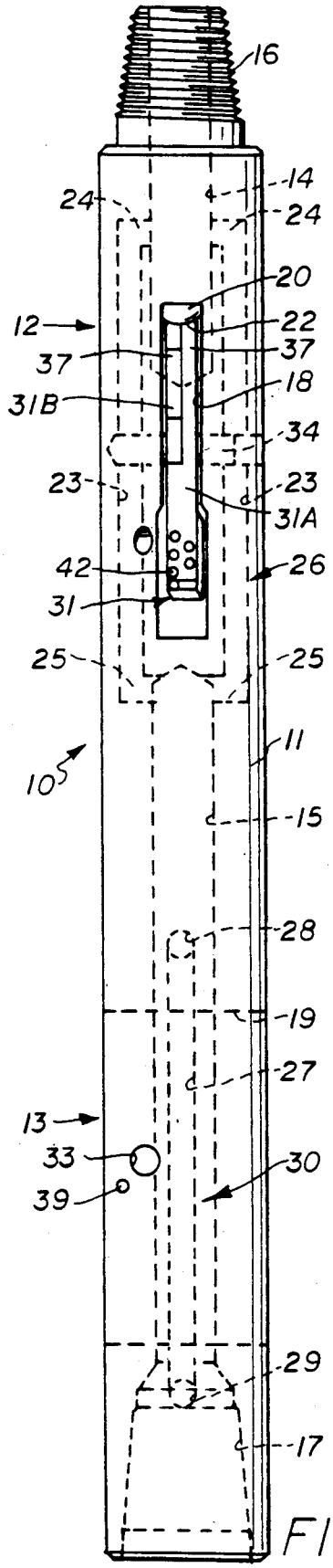
FIG. 1 is a side elevation of one embodiment of an underreamer tool in accordance with the present invention.
Figure 3:
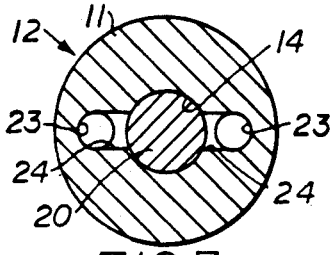
FIG. 3 is a transverse cross section of the underreamer taken along line 3—3 of FIG. 2 showing the longitudinal slots through the upper portion.

Referring to the drawings by numerals of reference, there is shown in FIGS. 1-10, a preferred underreamer tool 10. The tool 10 is an elongate cylindrical body 11 having an integral upper portion 12 and lower portion 13. An upper central bore 14 of uniform diameter extends downwardly a distance from the top end of the upper portion 12 and a lower central bore 15 of uniform diameter coaxial therewith extends upwardly a distance from the bottom end of the lower portion 13. Exterior threads 16 are provided at the top end of the upper portion 12 and interior threads 17 are formed in the bottom end of the lower portion 13. A suitable drill bit (not shown) is threadedly connected at the lower end of the tool.

An upper longitudinal slot 18 extends transversely through the upper portion 12 of &:he cylindrical body 11 and a lower longitudinal slot 19 extends transversely through the lower portion 13 of the cylindrical body 11. The upper and lower slots 18 and 19 extend transversely through the cylindrical body 11 at right angles to one another and receive cutting elements, described hereinafter. For ease of understanding, the transverse upper and lower longitudinal slots 18 and 19 will hereinafter be referred to as upper cutter blade slot 18 and lower cutter blade slot 19.

The upper central bore 14 extends downwardly from the top end of the cylindrical body 11 and terminates a distance into the upper cutter blade slot 18. The lower central bore 15 extends upwardly from the bottom end of the cylindrical body, through the lower cutter blade slot 19 and terminates a distance above the lower cutter blade slot 19. A cylindrical upper piston 20 is slidably received in the upper central bore 14 above the upper cutter blade slot 18 and a cylindrical lower piston 21 is slidably received in the upper central bore 15 above the lower cutter blade slot 19. The pistons 20 and 21 each have a rounded bottom end 22, and do not require a seal between their outer diameter and the respective central bores 14 and 15.

A pair of diametrically opposed longitudinal bores 23 disposed at right angles to the upper cutter blade slot 18 extend longitudinally from above to below the upper cutter blade slot 18. A pair of diametrically opposed passages 24 above the top end of the upper cutter blade slot 18 extend laterally from the upper central bore 14 to the longitudinal bores 23 and a second pair of diametrically opposed passages 25 beneath the upper cutter blade slot 18 extend laterally from the longitudinal bores 23 into the lower central bore 15. Thus, an upper fluid passageway 26 is established through the upper portion 12 of the tool 10 which communicates fluid from above the upper cutter blade slot 18 adjacent the upper piston 20 and back into the lower central bore 15 beneath the upper cutter blade slot 19.

The upper piston 20 is moved between an upper position with its upper end surface 20A positioned just above the opening to the lateral passages 24 and a lower position below the opening, thus fully exposing the passages 24 only after the piston has been fully moved.

Figure 6:
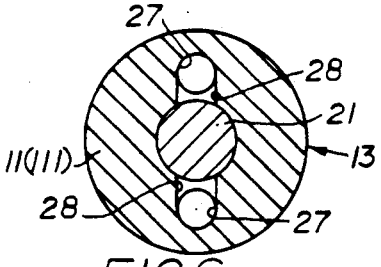
FIG. 6 is a transverse cross section of the underreamer taken along line 6—6 of FIG. 2 showing the lower piston in the lower portion of the underreamer tool.
Figure 7:
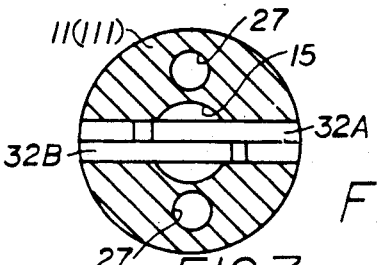
FIG. 7 is a transverse cross section of the underreamer taken along line 7—7 of FIG. 2 showing the lower cutter blade slot.
Figure 2:
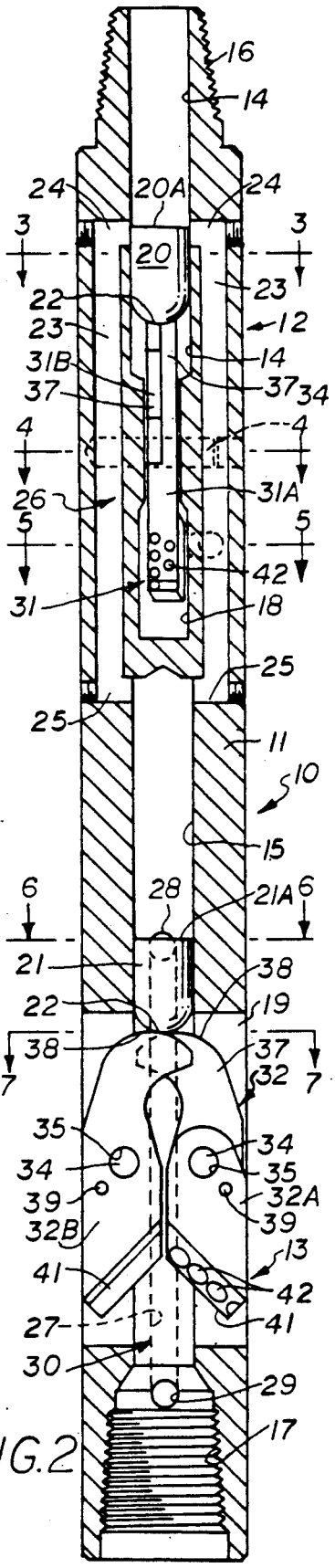
FIG. 2 is a longitudinal cross section of the underreamer of FIG. 1 showing both the upper and lower cutter blades in the retracted position.
Figure 8:
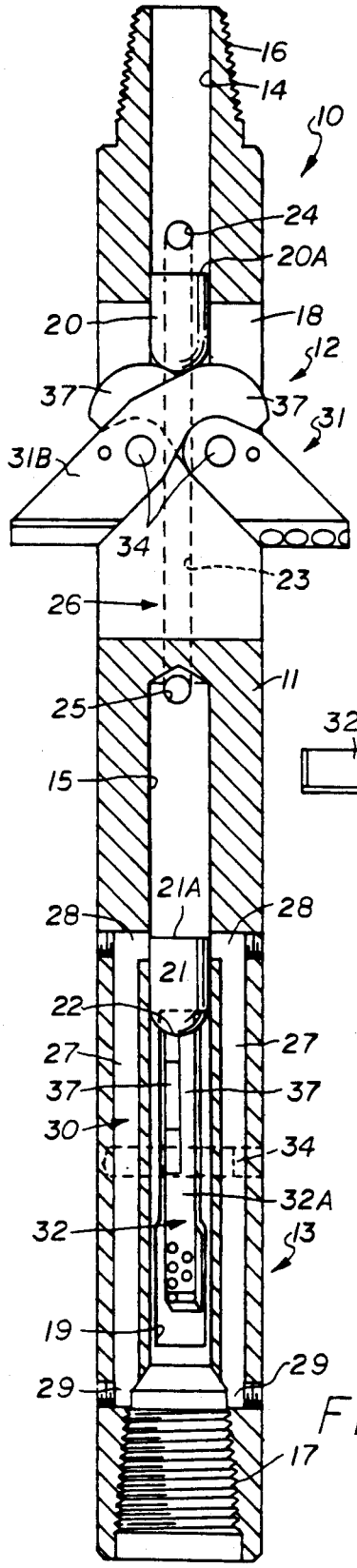
FIG. 8 is a longitudinal cross section of the underreamer of FIGS. 1 and 2 rotated 90° showing the upper cutter blades in the extended position and the lower cutter blades in the retracted position.
Figure 10:
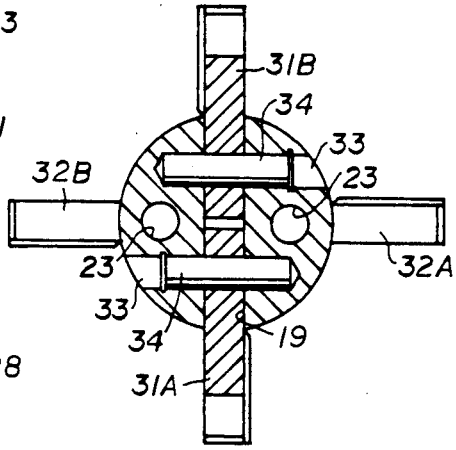
FIG. 10 is a transverse cross section of the underreamer taken along lines 10—10 of FIG. 9 showing both the upper and lower cutter blades in the extended position.

As best seen in FIGS. 2, 6, and 7, the lower portion of the cylindrical body 11 is provided with a pair of diametrically opposed longitudinal bores 27 disposed at right angles to the lower cutter blade slot 19 extend longitudinally from above the lower cutter blade slot 19 and terminate just above the internal threads 17 at the lower end. A pair of diametrically opposed passages 28 above the lower cutter blade slot 19 extend laterally from the lower central bore 15 to the longitudinal bores 27 and a second pair of diametrically opposed passages 29 beneath the lower cutter blade slot 19 extend laterally from just above the internal threads 17 to the longitudinal bores 27. Thus, a lower fluid passageway 30 is established through the lower portion of the tool 10 which communicates fluid from above the lower cutter blade slot 19 adjacent the lower piston 21 and back into the lower central bore 15 beneath the lower cutter blade slot 19.

The lower piston 21 is moved between an upper position with its upper end surface 21A positioned just above the opening to the lateral passages 28 and a lower position below the opening, thus fully exposing the passages 28 only after the piston has been fully moved.

It should be noted that both the upper and lower passageways 26 and 30 are in fluid communication with one another through the central bores 14 and 15 and both bypass the upper and lower cutter blade slots 18 and 19. Thus, a complete fluid flow passageway is established from the lateral passages 24 adjacent the top of the upper piston 20 and the lateral passages 28 adjacent top of the lower piston 21 which will discharge fluid back into the center of the tool 10 above the internally threaded lower end which receives the pin threaded upper end of the drill bit. Continuous flow of fluid through the passageways 26 and 30 to the drill bit is accomplished only after the upper piston 20 and lower piston 21 have been fully moved, and the lower piston 21 will not move until after the upper piston 20 has moved. Movement of the pistons 20 and 21 downward moves an upper pair of cutter blades 31 and a lower pair of cutter blades 32, respectively, from a retracted position to an extended position in planes at a right angle to each other.

In the following description of the upper and lower cutter blade configuration, the mounting details of the upper and lower cutter blades are substantially the same, and will be described simultaneously to avoid repetition.

Figure 4:
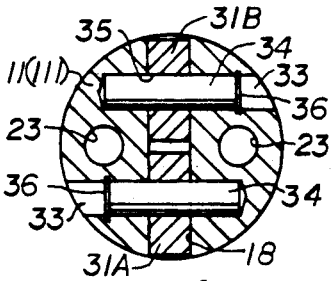
FIG. 4 is a transverse cross section of the underreamer taken along line 4—4 of FIG. 2 showing the pivotal connection of the upper cutter blades.

A pair of upper cutter blades 31 and lower cutter blades 32 are pivotally mounted in an overlapped relation within the upper cutter blade slot 18 and lower cutter blade slot 19, respectively. As seen in FIG. 4, a pair of laterally spaced parallel bores 33 extend inwardly a distance from the exterior of the cylindrical body 11 and transversely through the upper 18 and lower 19 cutter blade slots. Each upper blade 31A, 31B and lower blade 32A, 32B is individually pinned within their respective cutter blade slot by a pin 34 which is slidably received through a hole 35 in each blade and retained within the bores 33 by a retaining ring 36 installed in the open end of each bore.

Each blade 31A, 31B, 32A, and 32B is a generally flat rectangular member having a thinner flat portion 37 above the hole 35. The thinner flat portion 37 has a rounded top end 38. The cutter blades 31A, 31B, 32A and 32B are pinned within their respective slots 18 and 19 in opposed relation such that their thinner flat portions 37 overlap and the apex of their rounded top ends 38 are positioned at the center of the central bores 14 and 15. The rounded bottom end 22 of the upper and lower pistons 20 and 21 rides on the overlapped rounded top ends 38 of the upper and lower cutter blades 31 and 32 respectively. Shear pins 39 may also be provided which are received through a hole 40 in each blade and secured to the wall of the cutter blade slots 18 and 19 in a conventional manner.

Sufficient downward pressure on the top of the pistons 20 and 21 presses their rounded bottom ends 22 on the overlapped rounded ends 38 of the cutter blades causing the lower portion of the cutter blades to pivot outward in a scissors action. The bottom end 41 of each cutter blade is angled such that when the blades are expanded outward from the tool, their bottom ends will be generally perpendicular to the longitudinal tool axis. The bottom ends 41 of the cutter blades may be provided with a machined surface, cutting inserts, or wear inserts 42 for engaging certain types of formations and cutting a larger hole than created by the drill bit.

Figure 5:
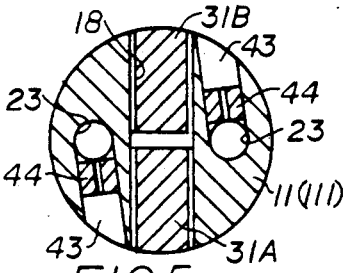
FIG. 5 is a transverse cross section of the underreamer taken along line 5—5 of FIG. 2 showing the fluid flow passages in communication with the longitudinal slots of the upper portion.

As seen in FIG. 5, a pair of holes 43 extend inwardly from opposite sides of the exterior of the upper portion 12 of the cylindrical body 11 to the longitudinal bores 23 and nozzles 44 are installed in each hole 43 by conventional means such as threading or press fitting them in. Similarly, but not shown, a pair of holes 43 extend inwardly from the exterior of the lower portion 13 of the cylindrical body 11 to the longitudinal bores 27 and receive nozzles 44. The nozzles holes 43 are disposed angularly in the cylindrical body and vertically positioned relative to each cutter blade to direct a jet spray of fluid onto the cutting surfaces of the blades when they are in the extended position whereby the blades are continuously cleaned during operation.

Because there is no threaded connection or intermediate sub between the upper and lower cutter blades, the unitary body configuration provides accurate alignment of the blades and prevents them from being out of phase.

DESCRIPTION OF ANOTHER PREFERRED EMBODIMENT

Figure 12:
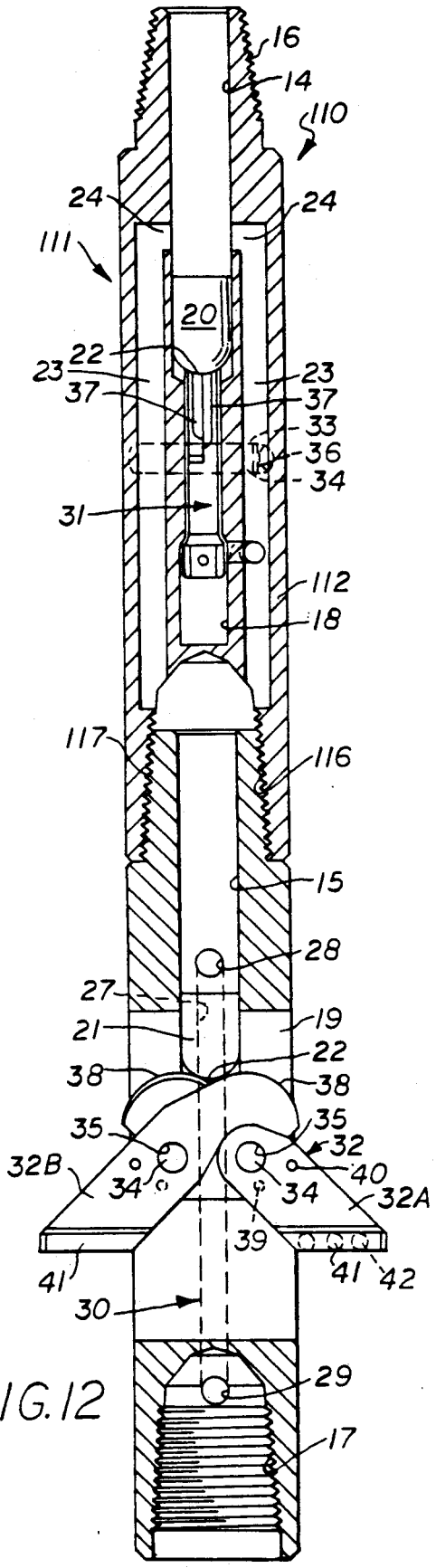
FIG. 12 is a longitudinal cross section of the underreamer of FIG. 11 showing the upper and lower cutter blades in the extended position.
Figure 11:
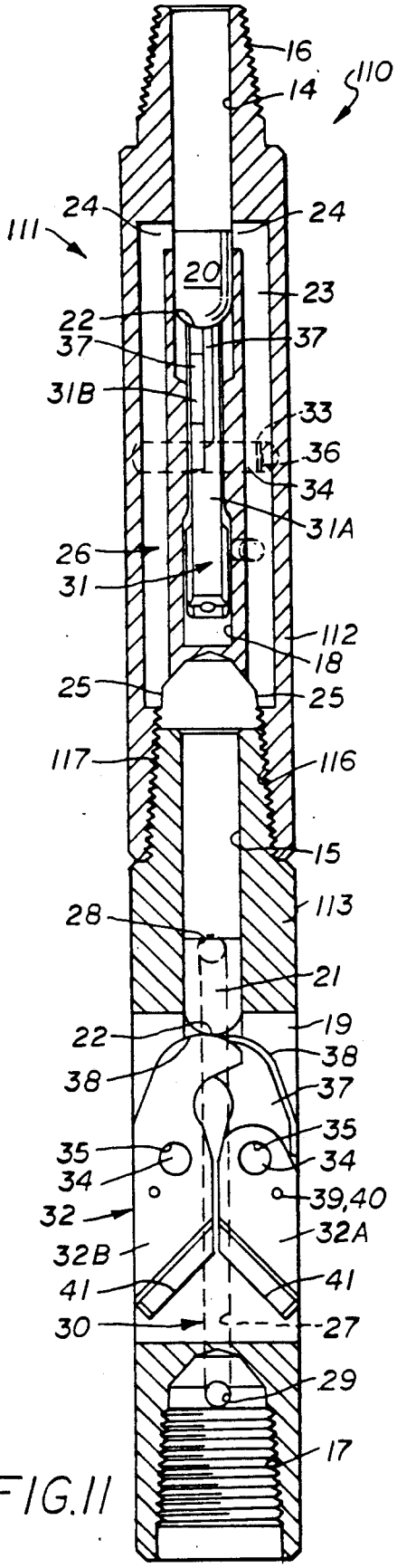
FIG. 11 is a longitudinal cross section of a two-piece embodiment of an underreamer tool in accordance with the present invention showing the upper and lower cutter blades in the retracted position.

Referring now to FIGS. 11 and 12, there is shown another embodiment of an underreamer tool which is essentially the same as the previously described underreamer tool 10 except that the elongate body is formed of two pieces which are threadedly connected together which allows it to be quickly separated to provide access for servicing the piston members. In the following description, the components which are the same as those previously described are assigned the same numerals of references and the modified components are assigned references numerals in the 100 series. To avoid repetition, some of the detailed description of the previously described components may not be repeated. It should also be understood, that the various cross sections of the two-piece embodiment would be substantially the same as those previously shown and described with reference to FIGS. 3–7 and 10. These cross sections have not been duplicated to avoid repetition.

Referring to FIGS. 11 and 12, a preferred two-piece underreamer tool 110 is shown. The tool 110 is an elongate cylindrical body 111 comprising an upper body 112 and lower body 113. Exterior threads 16 are provided at the top end of the upper body 112 and interior threads 116 are formed in the bottom end of the upper body 112. An upper central bore 14 of uniform diameter extends downwardly a distance from the top end of the upper body 112.

Similarly, exterior threads 117 are provided at the top end of the lower body 113 and interior threads 17 are formed in the bottom end of the lower body 112. A lower central bore 15 of uniform diameter coaxial with the upper bore 14 extends downwardly a distance from the top end of the lower body 113.

An upper longitudinal slot 18 extends transversely through the upper body 112 and a lower longitudinal slot 19 extends transversely through the lower body 113. The upper end of the lower body 113 is threadedly connected in the interior threads 116 in the lower end of the upper body 113 and the two bodies are joined such that the upper and lower slots 18 and 19 extending transversely through the bodies are secured at right angles to one another. For ease of understanding, the transverse upper and lower longitudinal slots 18 and 19 will hereinafter be referred to as upper cutter blade slot 18 and lower cutter blade slot 19.

The upper central bore 14 extends downwardly from the top end of the upper body 112 and terminates a distance into the upper cutter blade slot 18. The lower central bore 15 extends downwardly from the top end of the lower body 113 and terminates a distance into the lower cutter blade slot 19.

A cylindrical upper piston 20 is slidably received in the upper central bore 14 above the upper cutter blade slot 18 and a cylindrical lower piston 21 is slidably received in the upper central bore 15 above the lower cutter blade slot 19. The pistons 20 and 21 each have a rounded bottom end 22, and do not require a seal between their outer diameter and the respective central bores 14 and 15.

A pair of diametrically opposed longitudinal bores 23 disposed at right angles to the upper cutter blade slot 18 extend longitudinally from above to below the upper cutter blade slot 18. A pair of diametrically opposed passages 24 above the top end of the upper cutter blade slot 18 extend laterally from the upper central bore 14 to the longitudinal bores 23 and a second pair of diametrically opposed passages 25 beneath the upper cutter blade slot 18 extend laterally from just above the internal threads 116 to the longitudinal bores 23. Thus, an upper fluid passageway 26 is established through the upper body 112 of the tool 110 which communicates fluid from above the upper cutter blade slot 18 adjacent the upper piston 20 and back into the lower central bore 15 beneath the upper cutter blade slot 19.

The upper piston 20 is moved between an upper position with is upper end surface 20A positioned just above the opening to the lateral passages 24 and a lower position below the opening, thus fully exposing the passages 24 only after the piston has been fully moved.

As previously described and shown with reference to FIGS. 2, 6, 7, the lower body 113 is provided with a pair of diametrically opposed longitudinal bores 27 disposed at right angles to the lower cutter blade slot 19 which extend longitudinally from above the lower cutter blade slot 19 and terminate just above the internal threads 17 at the lower end. A pair of diametrically opposed passages 28 above the lower cutter blade slot 19 extend laterally from the lower central bore 15 to the longitudinal bores 27 and a second pair of diametrically opposed passages 29 beneath the lower cutter blade slot 19 extend laterally from just above the internal threads 17 to the longitudinal bores 27. Thus, a lower fluid passageway 30 is established through the lower portion of the tool 110 which communicates fluid from above the lower cutter blade slot 19 adjacent the lower piston 21 and back into the lower central bore 15 beneath the lower cutter blade slot 19.

The lower piston 21 is moved between an upper position with its upper end surface 21A positioned just above the opening to the lateral passages 28 and a lower position below the opening, thus fully exposing the passages 28 only after the piston has been fully moved.

It should be noted that both the upper and lower passageways 26 and 30 are in fluid communication with one another through the central bores 14 and 15 and both bypass the upper and lower cutter blade slots 18 and 19. Thus, a complete fluid flow passageway is established from the lateral passages 24 adjacent the top of the upper piston 20 and the lateral passages 28 adjacent top of the lower piston 21 which will discharge fluid back into the center of the tool 110 above the internally threaded lower end 17 which receives the pin threaded upper end of the drill bit. Continuous flow of fluid through the passageways 26 and 30 to the drill bit is accomplished only after the upper piston 20 and lower piston 21 have been fully moved, and the lower piston 21 will not move until after the upper piston 20 has moved. Movement of the pistons 20 and 21 downward moves an upper pair of cutter blades 31 and a lower pair of cutter blades 32, respectively, from a retracted position to an extended position in planes at a right angle to each other.

A pair of upper cutter blades 31 and lower cutter blades 32 are pivotally mounted in an overlapped relation within the upper cutter blade slot 18 and lower cutter blade slot 19, respectively. As seen in FIG. 4, a pair of laterally spaced parallel bores 33 extend inwardly a distance from the exterior of the cylindrical body 111 and transversely through the upper 18 and lower 19 cutter blade slots. Each upper blade 31A, 31B and lower blade 32A, 32B is individually pinned within their respective cutter blade slot by a pin 34 which is slidably received through a hole 35 in each blade and retained within the bores 33 by a retaining ring 36 installed in the open end of each bore.

Each blade 31A, 31B, 32A, and 32B is a generally flat rectangular member having a thinner flat portion 37 above the hole 35. The thinner flat portion 37 has a rounded top end 38. The cutter blades 31A, 31B, 32A and 32B are pinned within their respective slots 18 and 19 in opposed relation such that their thinner flat portions 37 overlap and the apex of their rounded top ends 38 are positioned at the center of the central bores 14 and 15. The rounded bottom end 22 of the upper and lower pistons 20 and 21 rides on the overlapped rounded top ends 38 of the upper and lower cutter blades 31 and 32 respectively. Shear pins 39 may also be provided which are received through a hole 40 in each blade and secured to the wall of the cutter blade slots 18 and 19 in a conventional manner.

Sufficient downward pressure on the top of the pistons 20 and 21 presses their rounded bottom ends 22 on the overlapped rounded ends 38 of the cutter blades causing the lower portion of the cutter blades to pivot outward in a scissors action. The bottom end 41 of each cutter blade is angled such that when the blades are expanded outward from the tool, their bottom ends will be generally perpendicular to the longitudinal tool axis. The bottom ends 41 of the cutter blades may be provided with a machined surface, cutting inserts, or wear inserts 42 for engaging certain types of formations and cutting a larger hole than created by the drill bit.

As seen in FIG. 5, a pair of holes 43 extend inwardly from opposite sides of the exterior of the upper portion 12 of the cylindrical body 111 to the longitudinal bores 23 and nozzles 44 are installed in each hole 43 by conventional means such as threading or press fitting them in. Similarly, but not shown, a pair of holes 43 extend inwardly from the exterior of the lower portion 13 of the cylindrical body 111 to the longitudinal bores 27 and receive nozzles 44. The nozzles holes 43 are disposed angularly in the cylindrical body and vertically positioned relative to each cutter blade to direct a jet spray of fluid onto the cutting surfaces of the blades when they are in the extended position whereby the blades are continuously cleaned during operation.

Because there is a threaded connection between the upper and lower bodies, the two-piece body may be easily disassembled to provide access for servicing the piston members.

OPERATION

The initial state of the tool 10 (110) is with both the upper and lower cutter blade pairs 31 and 32 retracted (FIG. 2). The tool is lowered through tubing inside a cased well bore or into an open cased well bore with the cutter blades retracted. Drilling fluid from the drilling motor or from the end of the drill pipe at the upper end of the tool introduces fluid pressure to move the upper piston 20 downward to expand the upper cutter blades 31 partially to the point of engaging the tubing or casing wall. At this stage, flow of drilling fluid through the inlet end of the tool (central bore 14) applies fluid pressure to the upper end surface 20A of the upper piston 20 which is vented through the wall of the body to permit movement of the piston before the upper and lower passages are opened to permit flow through to the drill bit. Venting is achieved as a result of fluid bypass around the piston and to the nozzles 44.

Figure 9:
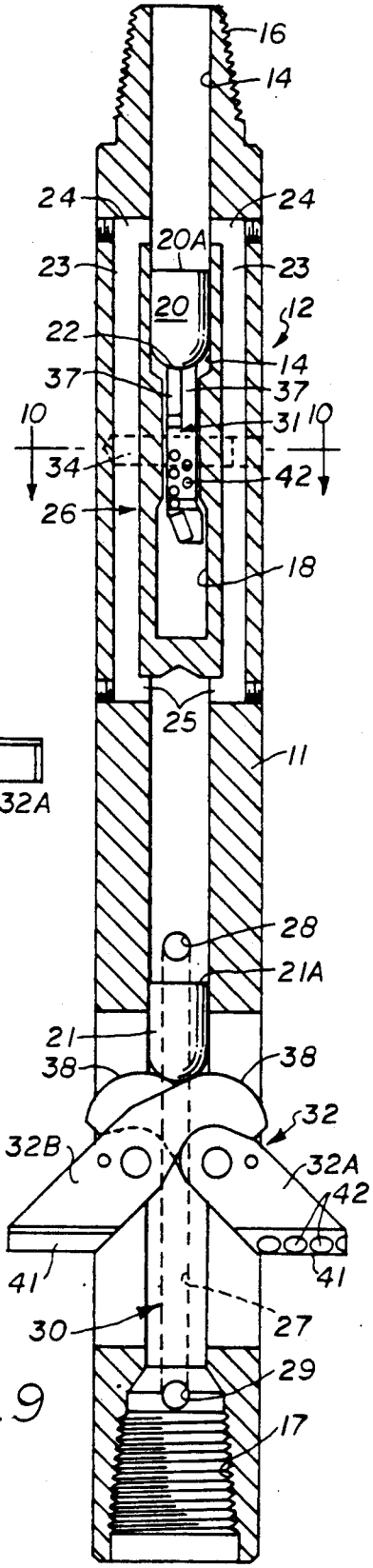
FIG. 9 is a longitudinal cross section of the underreamer of FIGS. 1 and 2 showing both the upper and lower cutter blades in the extended position.

As the lower end of the tool moves below the bottom end of the tubing by the reaming action of the drill bit, the lower end of the tool moves into the drilled out portion with the lower cutter blades 32 in a retracted position. When the bit has drilled a sufficient distance such that the upper portion of the tool is below the lower end of the tubing or casing, fluid pressure on the upper piston 21 moves it downward, forcing the upper cutter blades apart to the fully extended position (FIG. 8) exposing the opening to the upper fluid passageway and permitting fluid flow to the lower portion of the tool to apply fluid pressure to the upper end of the lower piston 21 to cause it to move downward and force the lower pair of cutter blades 32 to an open position (FIG. 9). In this position, flow of drilling fluid is through both the upper and lower fluid passageways and back into the central bore 15 in the tool lower portion and out through the drill bit.

In the extended position, the extended upper and lower cutter blade members 31 and 32 engage the wall of casing or the hole being cut at a right angle to one another and inherently function as a stabilizer for the tool. Since the upper and lower cutting elements extend in planes at a right angle to each other, stabilization is at four points equally spaced around the periphery of the hole.

On completion of the underreaming or clean-out operation, flow of drilling fluid is discontinued, thus discontinuing application of pressure to the upper and lower pistons 20 and 21, and on retraction of the tool through the tubing, the cutter blade members are retracted on engagement with the tubing wall.

Since there is no seal between the piston and the central bore, there is a small amount of fluid which is allowed to bypass the pistons and be discharged onto the top of the cutter blades and also through the nozzles 44 (FIG. 5) allowing cleaning action of the mechanical portions of the cutter blades by the fluid.

While this invention has been described fully and completely with special emphasis upon several preferred embodiments, it should be understood that within the scope of the appended claims the invention may be practiced otherwise than as specifically described herein.

We claim:

1. A downhole cutting tool comprising;

upper and lower body portions having a longitudinal cutter blade slots extending transversely therethrough, spaced apart and at a right angle to each other, a first longitudinal central bore extending from a top inlet opening to a central dividing wall, a second longitudinal central bore extending from a bottom outlet opening to said central dividing wall, said upper slots intersecting said first bore above said dividing wall, said lower slots intersecting said second bore below said dividing wall, an upper pair of cutter blade members pivotally mounted in said upper slots, a lower pair of cutter blade members pivotally mounted in said lower slots, an upper piston member slidably received in said first central bore above said upper slots and engaging said upper cutter blade members for moving the same between a retracted position with said upper slots and an extended position outward therefrom, a lower piston member slidably received in said second central bore above said lower slots and engaging said lower cutter blade members for moving the same between a retracted position within said lower slots and an extended position outward therefrom, a first fluid passageway spaced from said upper slots extending from said first central bore above said upper slots adjacent said upper piston member to said second central bore below said dividing wall, a second fluid passageway spaced from said lower slots extending from said second central bore above said lower slots adjacent said lower piston member to said bottom outlet, said upper and lower piston members being positioned within said central bores relative to said first and second fluid passageways such that said upper piston member is moveable between a first position substantially closing said first passageway and a second position opening said first passageway responsive to a predetermined fluid pressure acting thereon and said second piston member is movable between a first position substantially closing said second passageway and a second position opening said second passageway responsive to said first passageway being opened by said first piston member, whereby said lower pair of cutter blade members are sequentially moved to the extended position only after said upper pair of cutter blade members have been moved to the extended position and after both said upper and lower pairs of cutter blade members have been extended a continuous fluid flow path is established from the upper end to the lower end of the tool.

2. A tool according to claim 1 in which said tool upper body portion and said lower body portion are integral portions of a single elongate cylindrical body.

3. A tool according to claim 1 in which the top end of said upper portion has pin threads for connection to a string of tubing and the bottom end of said lower portion has box threads for receiving drill means.

4. A tool according to claim 3 in which said first central bore is of uniform diameter extending downwardly a predetermined distance from the top end of said upper portion and said second central bore is of uniform diameter coaxial therewith extending upwardly a predetermined distance from the bottom end of said lower portion.

5. A tool according to claim 4 in which said first central bore terminates a predetermined distance into said upper cutter blade slot and said second central bore extends upwardly through said lower cutter blade slot and terminates a predetermined distance thereabove.

6. A tool according to claim 5 in which said upper and lower piston members each comprise a cylindrical member having a rounded bottom end.

7. A tool according to claim 3 in which said first fluid flow passageway comprises an upper pair of diametrically opposed longitudinal passages disposed at a right angle to said upper slots which extend longitudinally from above to below said upper cutter blade slot, a first pair of diametrically opposed passages above the top end of said upper cutter blade slot extending laterally from said first central bore to said upper longitudinal passages, a second pair of diametrically opposed passages beneath said upper slots extending laterally from said upper longitudinal bores into said second central bore to establish an upper fluid passageway in said upper portion of said tool which communicates fluid from above said upper cutter blade slot adjacent said upper piston and back into said lower central bore beneath said upper cutter blade slot, said second fluid passageway comprises a lower pair of diametrically opposed longitudinal passages disposed at a right angle to said lower slots which extend longitudinally from above said lower slots and terminating just above said internal threads, a third pair of diametrically opposed passages above said lower slots extending laterally from said second central bore to said lower longitudinal passages, and a fourth pair of diametrically opposed passages beneath said lower cutter blade slot extending laterally from just above said internal threads to said lower longitudinal passages to establish a lower fluid passageway in said lower portion of said tool from above said lower slots adjacent said lower piston member and back into said second central bore beneath said lower slots.

8. A tool according to claim 7 in which said upper piston member is moved between an upper position with its upper end surface positioned just above the opening to said first lateral passages and a lower position below the opening, thus fully exposing the passages only after said upper piston member has been fully moved, and said lower piston member is moved between an upper position with its upper end surface positioned just above the opening to said third lateral passages and a lower position below the opening, thus fully exposing the passages only after the piston has been fully moved, whereby continuous flow of fluid through said first and second passageways to said outlet occurs only after said upper and said lower piston members have been fully moved, and said lower piston member does not move until after said upper piston member has fully moved.

9. A tool according to claim 1 in which said pair of upper cutter blades and said lower cutter blades are pivotally mounted in an overlapped relation within said upper cutter blade slot and said lower cutter blade slot respectively.

10. A tool according to claim 9 in which each said cutter blade is a generally flat rectangular member having a thinner flat portion above the pivotal connection which has a rounded top end, and said cutter blades are pinned within said respective slots in opposed relation such that their thinner flat portions overlap and the apex of said rounded top ends are positioned generally at the center of said upper and lower central bores, and each of said upper and lower piston members have rounded bottom ends abutting said overlapped rounded top ends of said upper and lower cutter blades respectively.

11. A tool according to claim 10 including shear pins installed through each blade and secured to the wall of said cutter blade slots.

12. A tool according to claim 10 in which a predetermined downward pressure on the top of said piston members will force said piston rounded bottom ends against said overlapped rounded ends of said cutter blades to cause the lower portion of said cutter blades to pivot outward in a scissors action.

13. A tool according to claim 10 in which the bottom end of each said cutter blade is angled such that when said blades are expanded outward from said tool, said bottom ends will be generally perpendicular to the longitudinal tool axis.

14. A tool according to claim 10 in which the bottom ends of said cutter blades have inserts for engaging and cutting predetermined types of formations.

15. A tool according to claim 1 including a pair of holes extending inwardly from opposite sides of the exterior of said tool to said longitudinal bores, and nozzle members installed in each said hole and positioned relative to each cutter blade to direct a jet spray of fluid onto the cutting surfaces of said cutter blades when they are in the said extended position whereby the blades are continuously cleaned during operation.

16. A tool according to claim 1 in which said elongate tool body is formed of separate upper and lower sections, said upper and lower sections each comprise an elongate cylindrical body having pin threads at their top end and box threads in their bottom ends, and the upper end of said lower section is threadedly engaged in the interior threads in the lower end of said upper section and the two sections are joined such that said upper and said lower cutter blade slots are positioned at a right angle to one another.

17. A tool according to claim 16 in which said first central bore extends downwardly a predetermined distance from the top end of said upper section and terminates a predetermined distance into said upper cutter blade slot, and said lower central bore extends downwardly a predetermined distance from the top end of said lower section coaxial with said upper central bore and terminates a predetermined distance into said lower cutter blade slot.

18. A downhole cutting tool comprising;

upper and lower body portions having a longitudinal passageway extending therethrough, said body portions having cutter blade slots extending transversely therethrough, spaced apart and at a right angle to each other, said slots intersecting said longitudinal passageway, an upper pair of cutter blade members pivotally mounted in said upper slots, a lower pair of cutter blade members pivotally mounted in said lower slots, an upper piston member slidably received in said longitudinal passageway above said upper slots and engaging said upper cutter blade members for moving the same between a retracted position within said upper slots and an extended position outward therefrom, a lower piston member slidably received in said longitudinal passageway above said lower slots and engaging said lower cutter blade members for moving the same between a retracted position within said lower slots and an extended position outward therefrom, said longitudinal passageway including a first passageway portion spaced from said upper slots extending from a point above said upper slots adjacent said upper piston member to said longitudinal passageway at a point below said upper slots, said longitudinal passageway including a second passageway portion spaced from said lower slots extending from a point above said lower slots adjacent said lower piston member to a point below said lower slots, said upper and lower piston members being positioned within said longitudinal passageway relative to said first and second passageway portions such that said upper piston member is movable between a first position substantially closing said first passageway portion and a second position opening said first passageway portion responsive to a predetermined fluid pressure acting thereon and said second piston member is movable between a first position substantially closing said second passageway portion and a second position opening said second passageway portion responsive to said first passageway portion being opened by said first piston member, whereby said lower pair of cutter blade members are sequentially moved to the extended position only after said upper pair of cutter blade members have been moved to the extended position and after both said upper and lower pairs of cutter blade members have been extended a continuous fluid flow path is established from the upper end to the lower end of the tool.

19. A tool according to claim 18 in which said tool upper body portion and said lower body portion are integral portions of a single elongate cylindrical body.

20. A tool according to claim 18 in which said upper and lower piston members each comprise a cylindrical member having a rounded bottom end.

21. A tool according to claim 18 in which said first passageway portion comprises an upper pair of diametrically opposed longitudinal passages disposed at a right angle to said upper slots which extend longitudinally from above to below said upper cutter blade slot, a first pair of diametrically opposed passages above the top end of said upper cutter blade slot extending laterally from said longitudinal passageway to said upper passages, a second pair of diametrically opposed passages beneath said upper slots extending laterally from said upper passages to said longitudinal passageway to communicate fluid from above said upper cutter blade slot adjacent said upper piston to a point below said upper cutter blade slot, said second passageway portion comprises a lower pair of diametrically opposed longitudinal passages disposed at a right angle to said lower slots which extend longitudinally from above to below said lower slots, a third pair of diametrically opposed passages above said lower slots extending laterally from said longitudinal passageway to said lower passages, and a fourth pair of diametrically opposed passages beneath said lower slots extending laterally from said longitudinal passageway to said lower longitudinal passages to communicate fluid from above said lower slots adjacent said lower piston member and back into said longitudinal passageway adjacent to the outlet therefrom.

22. A tool according to claim 2 in which said upper piston member is moved between an upper position with its upper end surface positioned just above the opening to said first lateral passages and a lower position below the opening, thus fully exposing the passages only after said upper piston member has been fully moved, and said lower piston member is moved between an upper position with its upper end surface positioned just above the opening to said third lateral passages and a lower position below the opening, thus fully exposing the passages only after the piston has been fully moved, whereby continuous flow of fluid through said first and second passageways to said outlet occurs only after said upper and said lower piston members have been fully moved, and said lower piston member does not move until after said upper piston member has fully moved.

23. A tool according to claim 18 in which said pair of upper cutter blades and said lower cutter blades are pivotally mounted in an overlapped relation within said upper cutter blade slot and said lower cutter blade slot respectively.

24. A tool according to claim 23 in which each said cutter blade is a generally flat rectangular member having a thinner flat portion above the pivotal connection which has a rounded top end, and said cutter blades are pinned within said respective slots in opposed relation such that their thinner flat portions overlap and the apex of said rounded top ends are positioned generally at the center of said upper and lower central bores, and each of said upper and lower piston members have rounded bottom ends abutting said overlapped rounded top ends of said upper and lower cutter blades respectively.

25. A tool according to claim 24 in which a predetermined downward pressure on the top of said piston members will force said piston rounded bottom ends against said overlapped rounded ends of said cutter blades to cause the lower portion of said cutter blades to pivot outward in scissors action.

26. A tool according to claim 24 in which the bottom end of each said cutter blade is angled such that when said blades are expanded outward from said tool, said bottom ends will be generally perpendicular to the longitudinal tool axis.

27. A tool according to claim 24 in which the bottom ends of said cutter blades have inserts for engaging and cutting predetermined types of formations.

28. A tool according to claim 18 including a pair of holes extending inwardly from opposite sides of the exterior of said tool to said longitudinal passageway, and nozzle members installed in each said hole and positioned relative to each cutter blade to direct a jet spray of fluid onto the cutting surfaces of said cutter blades when they are in the said extended position whereby the blades are continuously cleaned during operation.

29. A tool according to claim 18 in which said elongate tool body is formed of separate upper and lower sections, said upper and said lower sections each comprise an elongate cylindrical body having pin threads at their top end and box threads in their bottom ends, and the upper end of said lower section is threadedly engaged in the interior threads in the lower end of said upper section and the two sections are joined such that said upper and said lower cutter blade slots are positioned at a right angle to one another.

30. A tool according to claim 29 in which said longitudinal passageway includes a first central bore extending downwardly a predetermined distance from the top end of said upper section and terminating a predetermined distance into said upper cutter blade slot, and a second central bore extending downwardly a predetermined distance from the top end of said lower section coaxial with said first central bore and terminating a predetermined distance into said lower cutter blade slot.

31. A method of cutting material located within a borehole having a tubing or casing disposed therein, said method comprising the steps of;

lowering an underreamer tool into .said tubing or casing, which underreamer tool includes;

an upper piston member responsive to pressurized fluid operatively connected to an upper pair of cutter blade members movable below said tubing or casing to an extended position in response to a pressurized fluid, and a lower piston member responsive to pressurized fluid operatively connected to a lower pair of cutter blade members movable below said tubing or casing to an extended position in response to a pressurized fluid, said upper piston member controlling said pressurized fluid flow to said lower piston member such that said lower pair of cutter blade members are moved to their extended position only after said upper pair of cutter blade members have been moved to their extended position;

rotating and lowering said underreamer tool through said lower end of said tubing or casing and into said borehole;

applying a pressurized fluid to said underreamer tool so that said upper piston moves said upper pair of cutter blade members to their extended position when lowered below said tubing or casing and into said borehole and allows pressurized fluid to flow to said lower piston member;

maintaining rotating and lowering said underreamer tool in said borehole through and after said step of allowing pressurized fluid to flow to said lower piston member and cutting said material with said extended upper pair of cutter blade members;

maintaining applying a pressurized fluid to said underreamer tool so that said lower piston member moves said lower pair of cutter blade members to their extended position when said upper pair of members is lowered below said tubing or casing and into said borehole;

maintaining said upper and lower pairs of members in their respective extended positions, and concurrently continuing rotating and lowering said underreamer tool against said material in said borehole, stabilizing said rotating underreamer tool with said extended cutter blade members and cutting said material in said borehole with said extended upper and lower pair of cutter blade members.

32. A method as defined in claim 31, wherein;

the step of allowing pressurized fluid to flow to said lower piston member includes opening a fluid flow passageway through said underreamer tool to the lower piston member.

33. A method as defined in claim 31, wherein;

said underreamer tool includes drilling means at its lower end, and said step of maintaining applying a pressurized fluid to said underreamer tool so that said lower piston member moves said lower pair of cutter blade members to their extended position includes opening a fluid flow passageway into the interior of said underreamer tool to apply pressurized fluid to said drilling means.

34. A method as claimed in claim 33, wherein;

said underreamer tool includes nozzle means adjacent said cutter blade members, and said steps of applying a pressurized fluid to said underreamer so that said upper piston moves said upper pair of cutter blade members to their extended position and said lower piston member moves the lower pair of cutter blade members to their extended position includes opening a fluid flow passageway through said nozzle members to apply pressurized fluid to the extended cutter blade members.

* * * * *